US009556654B2

(12) United States Patent
Fukumoto

(10) Patent No.: US 9,556,654 B2
(45) Date of Patent: Jan. 31, 2017

(54) LOCK DEVICE

(75) Inventor: Mitsuru Fukumoto, Utsunomiya (JP)

(73) Assignee: NIFCO INC., Yokohama-Shi, Kanagawa (JP)

( * ) Notice: Subject to any disclaimer, the term of this patent is extended or adjusted under 35 U.S.C. 154(b) by 68 days.

(21) Appl. No.: 14/346,529

(22) PCT Filed: Sep. 7, 2012

(86) PCT No.: PCT/JP2012/072973

§ 371 (c)(1),
(2), (4) Date: Apr. 10, 2014

(87) PCT Pub. No.: WO2013/042559

PCT Pub. Date: Mar. 28, 2013

(65) Prior Publication Data

US 2014/0225379 A1 Aug. 14, 2014

(30) Foreign Application Priority Data

Sep. 22, 2011 (JP) ..... 2011-206686

(51) Int. Cl.
*E05C 9/10* (2006.01)
*E05B 83/30* (2014.01)
(Continued)

(52) U.S. Cl.
CPC ..... *E05B 83/30* (2013.01); *E05B 83/28* (2013.01); *E05C 9/045* (2013.01); *Y10T 292/0844* (2015.04)

(58) Field of Classification Search
CPC ..... E05B 83/22; E05B 83/28; E05B 83/30; E05B 83/32; E05C 9/045; E05C 9/002; E05C 9/008; E05C 9/04; E05C 9/042;E05C 1/00; E05C 1/004; E05C 1/02; E05C 1/06; E05C 1/065; E05C 1/08; E05C 1/12; E05C 1/14; E05C 1/145
(Continued)

(56) References Cited

U.S. PATENT DOCUMENTS 1,126,223 A * 1/1915 Johnson ..... 292/40
6,669,243 B2 * 12/2003 Katoh et al. ..... 292/34
(Continued)

FOREIGN PATENT DOCUMENTS

JP 3863837 B2 12/2006
JP 2007-100343 A 4/2007
JP 2009-299268 A 12/2009

OTHER PUBLICATIONS

PCT, International Search Report for PCT/JP2012/072973.

*Primary Examiner* — Alyson M Merlino
(74) *Attorney, Agent, or Firm* — Manabu Kanesaka

(57) ABSTRACT

A lock device includes a housing; a pair of rods disposed slidably in a linear direction relative to the housing, and switched between a lock position separated from each other, and a release position approaching each other; and an operating member allowing the rods to be switched from the lock position to the release position by changing from an initial state to an operating state. The lock device engages/disengages opening/closing members with/from a main member through the rods, and is formed by the housing, the rod, the operating member, a connection member urging the rods in a connected state in a direction of separating the rods from each other, and an urging member disposed between the housing and the operating member and serving as a swaying resistance of the operating member when switched from the operating state to the initial state through an urging force of the connection member.

8 Claims, 8 Drawing Sheets

(51) Int. Cl.

| | |
|---|---|
| ***E05C 9/04*** | (2006.01) |
| ***E05B 83/28*** | (2014.01) |
| *E05C 1/12* | (2006.01) |

(58) Field of Classification Search
USPC ... 292/32–34, 37, 40, 8, 137, 163, 165, 170, 292/169, 169.11, 173, 140, 143; 296/37.8, 296/37.12
See application file for complete search history.

(56) References Cited

U.S. PATENT DOCUMENTS

| | | | | |
|---|---|---|---|---|
| 7,455,333 | B2 * | 11/2008 | Ookawara | 292/34 |
| 7,695,028 | B2 * | 4/2010 | Katou et al. | 292/34 |
| 8,033,582 | B2 * | 10/2011 | Sawatani et al. | 292/33 |
| 8,403,374 | B2 * | 3/2013 | Shimizu et al. | 292/32 |
| 2009/0212586 | A1 * | 8/2009 | Blanck et al. | 296/37.8 |
| 2011/0241358 | A1 | 10/2011 | Washio | |
| 2012/0261937 | A1 * | 10/2012 | Buchheit | 296/37.12 |

* cited by examiner

LOCK DEVICE

FIELD OF TECHNOLOGY

The present invention relates to a lock device for use in, preferably, engaging/disengaging through a pair of rods approaching to or separating from each other among lock devices engaging with or disengaging from an opening-closing body with respect to a main body.

BACKGROUND ART

FIGS. 8(*a*) and 8(*b*) show a lock device disclosed in Patent Document 1, and FIG. 8(*a*) is an exploded structural view, and FIG. 8(*b*) is an operational explanatory view. The lock device in FIGS. 8(*a*) and 8(*b*) comprises an operating member (a handle) 1 including right-and-left cylindrical portions 6; a support frame 2 holding the operating member; two rods (slide pins) 3 disposed slidably in a linear line direction through the cylindrical portions 6 relative to the support frame 2, and switched between a lock position separated from each other, and a release position approaching each other; two cam members 4 connected on base end sides of the respective rods 3, and urging the rods to move forward and backward; and two coil springs 5 disposed in the respective cylindrical portions 6 and respectively urging the corresponding rods 3 in a separating direction. In a basic operation, the lock device is switched between the lock position wherein the respective rods 3 are slid in a direction of separation by the coil springs 5 as shown in FIG. 8(*b*) so as to be engaged with lock holes H of panels P which are a main body; and the release position (a position wherein an engagement of each rod relative to the lock hole H can be released) wherein each rod 3 sways the operating member 1 from an initial state to an operating state so as to urge both the rods against an urging force from the lock position.

Essential features reside in that each rod 3 is switched from the lock position to the release position through the cam member 4 by a sway of the operating member 1; each rod 3 is operated and connected through the cam member 4 relative to the operating handle 1; back end portion sides of the respective rods 3 are formed in two-pronged-shaped elastic pieces 11; and there are provided locking holes 15 in cylindrical end portions 4*a* of the respective cam members 4, and projections 12 engaging with and disengaging from the locking holes 15 thereof in the respective elastic pieces 11. In the essential operation, even in a locked state wherein each rod 3 is engaged with the lock hole H on a panel side as shown in FIG. 8(*b*), only by rotating the rod 3 relative to the cam member 4, the projection 12 comes to free from the locking hole 15 on a cam member side, so that a drive mechanism including the rod 3 and the cam member 4 can be easily removed as well.

PRIOR ART DOCUMENT

Patent Document

Patent Document 1: Japanese Patent No. 3863837

SUMMARY OF THE INVENTION

Problems to be Solved by the Invention

The aforementioned conventional lock device could not be yet satisfied from the following aspects. Namely, (A) The aforementioned lock device has a structure of a total of eight parts including the operating member 1, the support frame 2, the two rods 3, the two cam members 4, and the two coil springs 5 as a device structure, so that parts control is complicated or there is a limit in respect of reducing a manufacturing cost. Consequently, a cost reduction is attempted by reducing the number of members as little as possible.

(B) The aforementioned lock device is formed by the cam members 4 mounted on the respective rods, and convex portions 7 inside the cylindrical portions 6 on an operating member side as a mechanism synchronously approaching or separating each rod 3. For example, when the operating member 1 sways to the operating state lifting the operating member 1 from the initial state, the convex portions 7 move along groove edges of corresponding cam grooves 18 on the cam member side so as to pull the cam member 4 into the cylindrical portion 6 against an urging force of the coil spring 5. As a result, both the rods approach, i.e., the rod 3 moves backward so as to release the engagement with the lock hole H. In such a mechanism, when the operating member 1 is returned to the initial state from the operating state, by the urging force accumulated in the coil spring 5, the operating member 1 is rapidly switched to the initial state, and at that time, a return tapping sound is generated. As for a countermeasure example for that, there is a structure wherein an O-ring is disposed between the cam member and the cylindrical portion on the operating member side to generate a sliding resistance when the rod slides so as to reduce the return tapping sound (Japanese Patent No. 4077391). Although this countermeasure is more simplified than adding a braking damper, component members come to a structure with a total of ten parts.

An object of the present invention is to solve the aforementioned problems, to reduce the number of parts, and to easily diminish the return tapping sound of the operating member so as to reduce a cost and to improve a quality.

Means for Solving the Problems

In order to attain the aforementioned object, in the present invention, a lock device which allows an opening-closing body to engage with or disengage from a main body through each rod, comprises a housing; a pair of rods disposed slidably in a linear direction relative to the housing, and switched between a lock position separated from each other, and a release position approaching each other; and an operating member allowing each rod to be switched from the lock position to the release position by being swayed from an initial state to an operating state. The lock device is formed by the housing; the rod; the operating member; a connection member urging both the rods in a connected state in a direction of separating the rods from each other; and an urging member disposed between the housing and the operating member, and serving as a swaying resistance of the operating member when the operating member is switched from the operating state to the initial state through an urging force of the connection member.

Here, as for the "opening-closing body" and the "main body", for example, if the opening-closing body is a lid type, the main body will be various types of chassis and the like wherein the main body is opened and closed or is covered by the lid type thereof, and if the opening-closing body is a glove compartment type, the main body will be various types of panels and the like disposing the glove compartment type. Basically, the opening-closing body may be a member provided that the opening-closing body moves in a regular manner relative to a main body side. The "serving as a swaying resistance of the operating member" means that when the operating member is switched from the operating state (the release position wherein each rod moves back and comes free from a lock hole so as to release an engagement) to the initial state (the lock position wherein each rod protrudes and can be engaged with the lock hole) through the urging force of the connection member, as compared to a case without the urging member, the operating member is returned gently or at a damped speed.

It is preferable that the present invention described hereinabove is embodied as follows.

(1) It is structured such that the urging force urging the rod by the connection member is larger than a stress of the urging member applied to the rod through the operating member. In that embodiment, a strength of each urging force of the urging member and the connection member is specified to confirm, and if the urging force urging the rod in a lock position direction by the connection member is smaller than the stress (it may as well be considered as the urging force urging the rod in the lock position direction through the operating member) caused by the urging force of the urging member applied to the rod, the operating member cannot be maintained in the initial state even at a non-operation time (when the operating member is not operated). However, such problem can be solved.

(2) It is structured to include an inclination portion provided in one of either the rod or the operating member; and an arm portion provided in the other of either the rod or the operating member, and abutting against the inclination portion. When the operating member is swayed from the initial state to the operating state, both the rods approach each other against the urging force of the connection member by a cam operation of the inclination portion and the arm portion. In that embodiment, as a drive mechanism driving each rod synchronously from the lock position in a release position direction by a sway of the operating member, a cam structure of the inclination portion and the arm portion are employed, so that as in a case of an embodiment, one of the inclination portion or the arm portion can be integrally formed respectively in the operating member and the rod so as to maintain a simplified structure.

(3) The urging member is formed by a coil spring. Incidentally, in the urging member, as the coil spring, a torsion coil spring is most suitable in the same manner as the following connection member. In that embodiment, since the coil spring is used as the urging member, it is possible to provide durability for thermal environment and aging with the simple structure and to improve reliability.

(4) The connection member is formed by the torsion coil spring. In that embodiment, the torsion coil spring is used as the connection member so as to excel in an adjustment of the strength of the urging force with the simple structure.

(5) The torsion coil spring is structured such that a winding portion is disposed in a portion deviated from a shaft line in a slide direction of each rod, and that both end portions are respectively locked in a different side of each rod. In that embodiment, in the torsion coil spring, the winding portion is deviated from the shaft line in the slide direction of each rod as in the case of the embodiment, it is preferable for a case, especially controlling a space in a shaft line direction to be small.

Effect of the Invention

The present invention can solve the aforementioned problems, and can provide the following advantages. Namely, at first, in the lock device of the present invention, with respect to the aforementioned aspect (A), component members are formed by a total of six parts of the housing, the two rods, the operating member, the connection member, and the urging member so as to reduce the number of members, which become important in reducing a manufacturing cost, and to facilitate a cost reduction. As for other characteristics, there are no intermediate assembly parts such as cam members in Patent Document 1, and the rod and the operating member are respectively incorporated in the housing separately so as to facilitate an assembly operation as well.

Secondly, in the lock device of the present invention, with respect to the aforementioned aspect (B), when the operating member is switched from the operating state to the initial state through the urging force of the connection member, there is included the urging member serving as the swaying resistance of the operating member so as to reduce a tapping sound of the operating member generated when the operating member is switched from the operating state to the initial state, and even if the operating member is subjected to vibrations in the initial state, rattles can be controlled.

Thirdly, the urging member of the present invention is simplified as compared to a structure using an existing braking damper, and has an advantage in cost-wise as well. Also, the urging member of the present invention excels in that the urging member is a single member compared to a structure using the aforementioned two O-rings, and that the urging member is not readily affected by aging or the thermal environment and the like.

BEST MODES OF CARRYING OUT THE INVENTION

Hereinafter, embodiments of the present invention will be explained with reference to attached drawings. In this explanation, a structure, an assembly, and an operation of a lock device will be described in detail in that order.

Figure 1A:
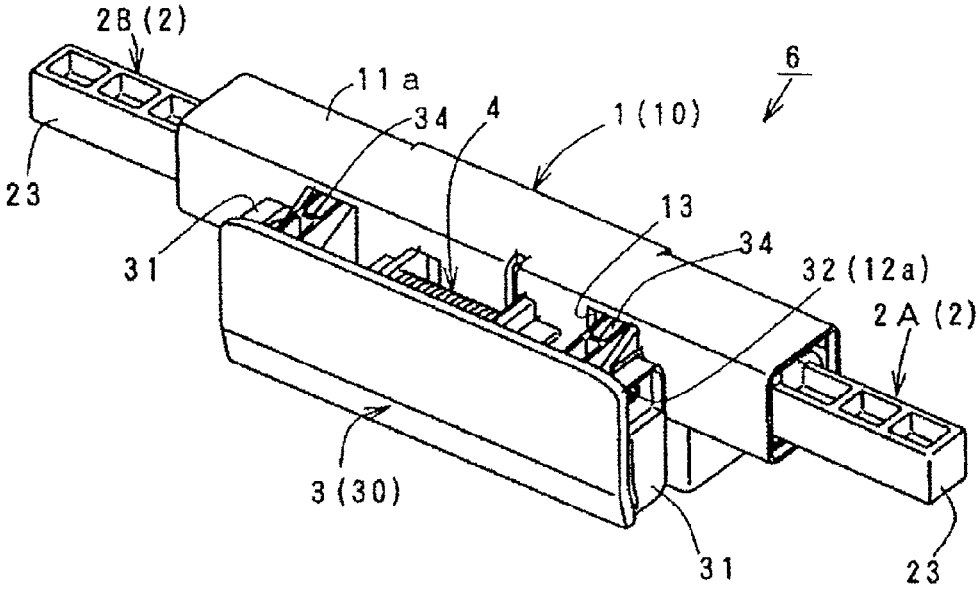
FIGS. 1(*a*) and 1(*b*) show an exterior of a lock device according to an embodiment of the present invention, wherein FIG. 1(*a*) is a perspective view showing the lock device from a front face side, and FIG. 1(*b*) is a perspective view showing the lock device from a back face side.
Figure 1B:
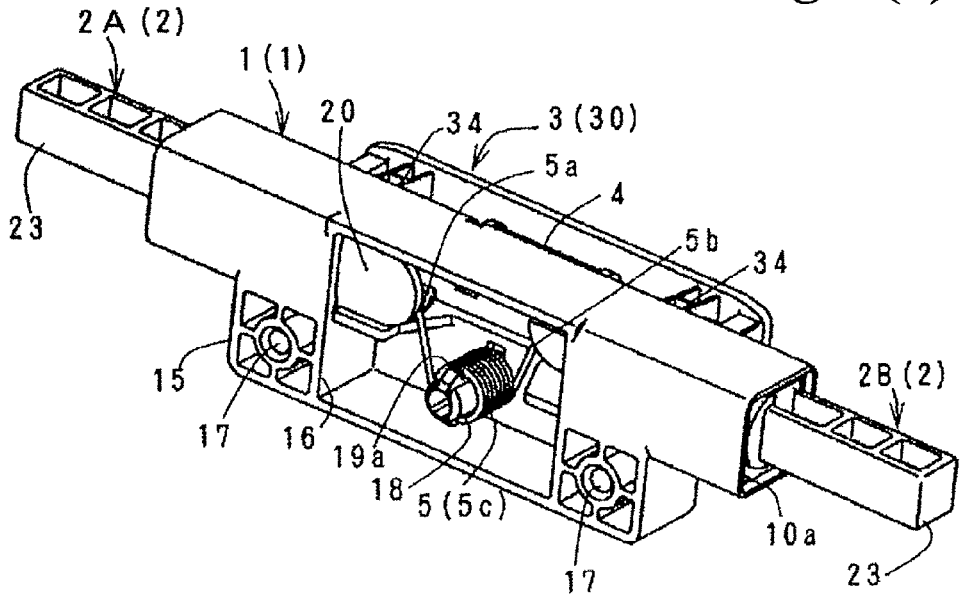
Figure 2A:
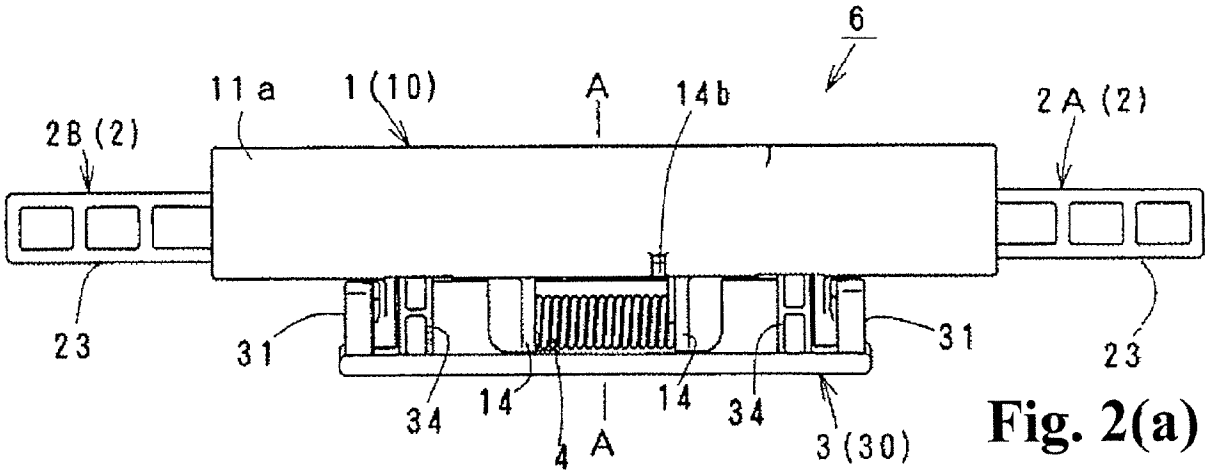
FIGS. 2(*a*) and 2(*b*) show details of the lock device, wherein FIG. 2(*a*) is a top view, and FIG. 2(*b*) is a front view.
Figure 2B:
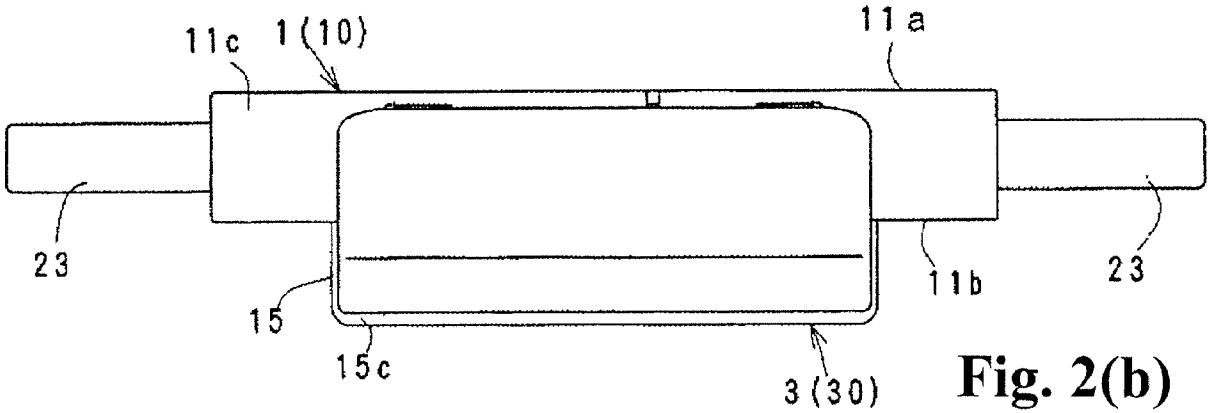
Figure 3A:
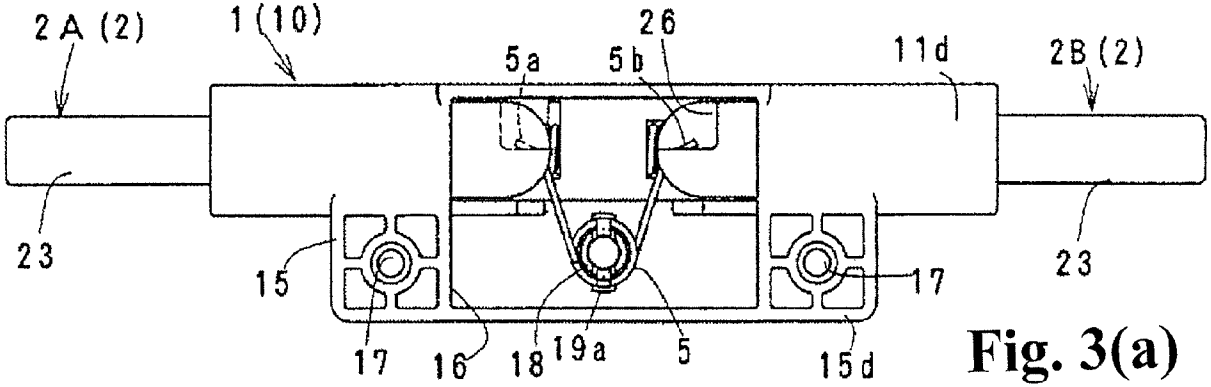
FIGS. 3(*a*), 3(*b*), and 3(*c*) show the details of the lock device, wherein FIG. 3(*a*) is a back view, FIG. 3(*b*) is a left side view, and FIG. 3(*c*) is a cross-sectional view taken along a line A-A in FIG. 2(*a*).
Figure 3C:
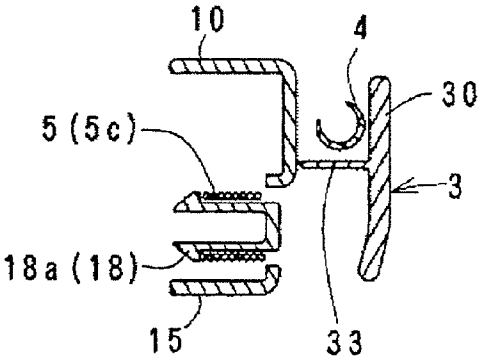
Figure 3B:
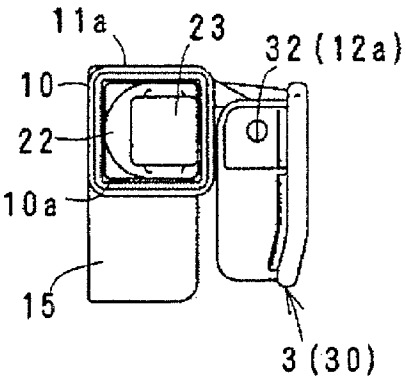
Figure 7A:
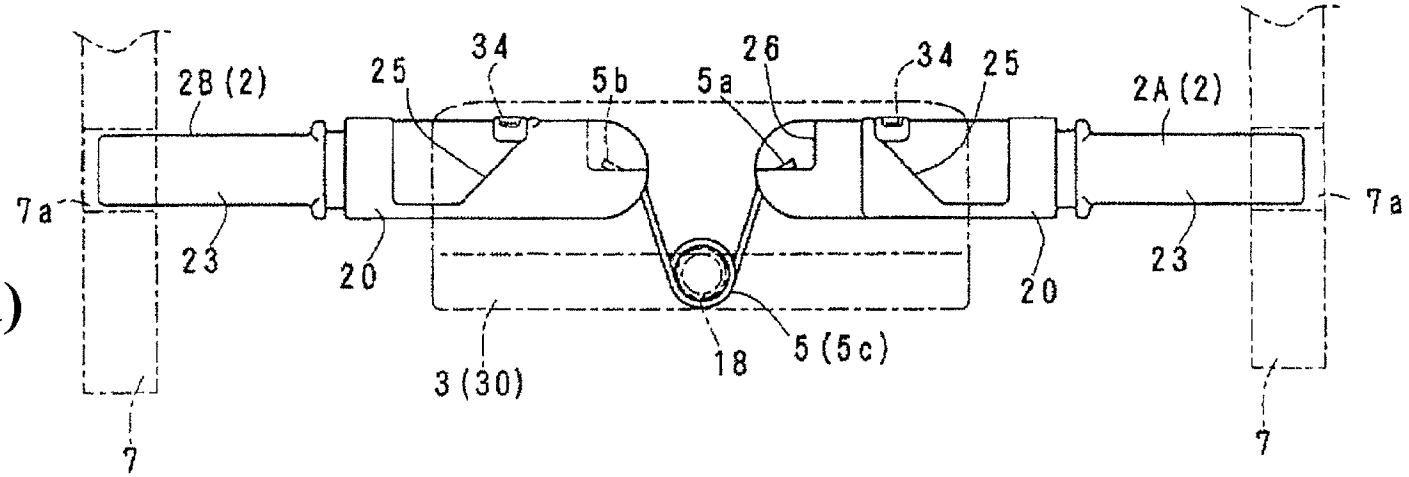
FIGS. 7(*a*) and 7(*b*) are drawings showing the lock device from the front face side by additionally omitting the operating member from FIGS. 6(*a*) and 6(*b*), wherein FIG. 7(*a*) is a drawing showing the rod in the lock position, and FIG. 7(*b*) is a drawing showing the rod in the release position.
Figure 7B:
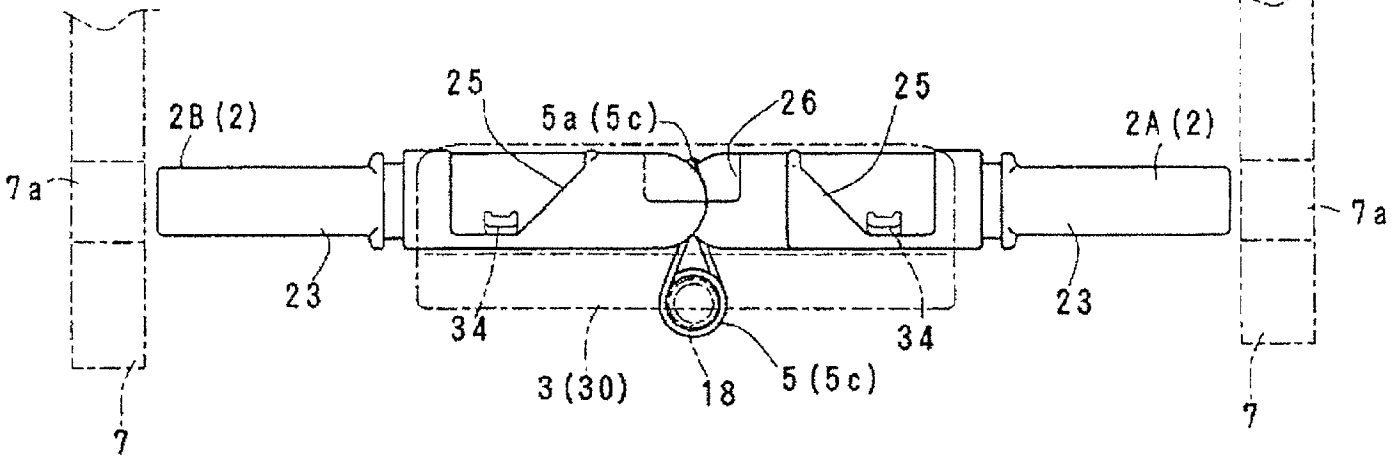
Figure 8A:
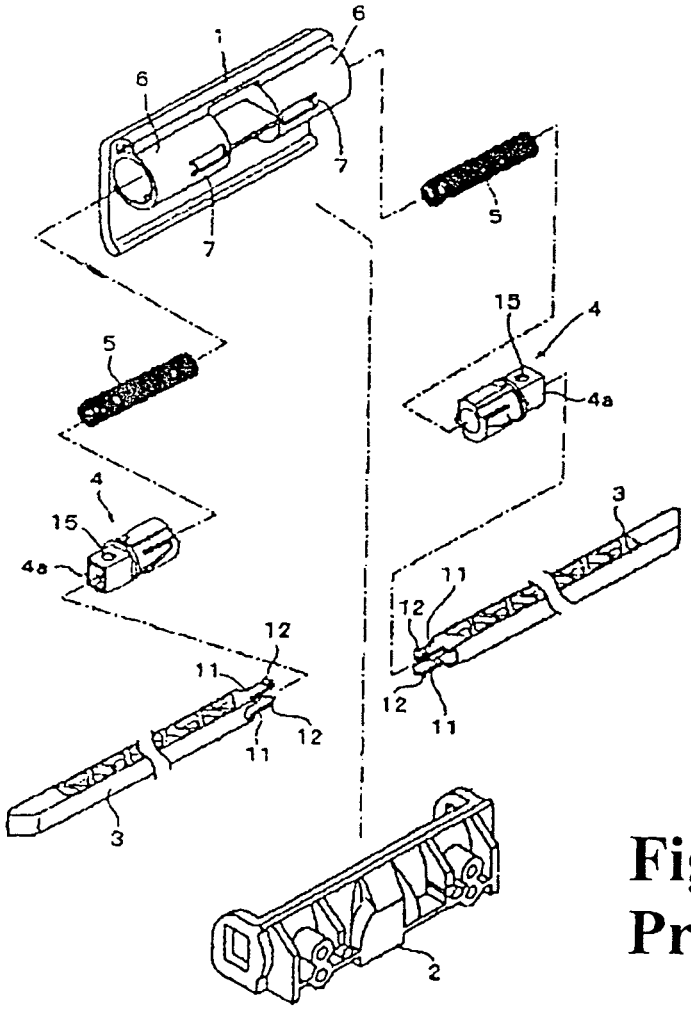
Fig. 8(a) Prior Art
FIGS. 8(*a*) and 8(*b*) show a lock device of Patent Document 1, wherein FIG. 8(*a*) is an exploded perspective view, and FIG. 8(*b*) is an operational view showing the lock device in a lock state.
Figure 8B:
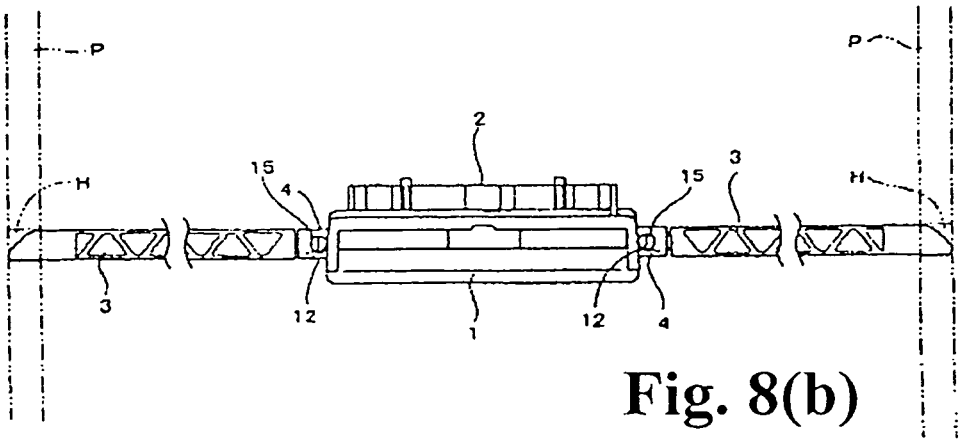
Fig. 8(b) Prior Art

(Structure of lock device) As shown in FIG. 1(*a*) to FIG. 7(*b*), a lock device 6 of the embodiment is formed by a housing 1; a pair of rods 2A and 2B (2); an operating member 3 allowing each rod 2A and 2B to be switched from a lock position protruded from the housing 1 to a release position moved backward; a torsion coil spring 5 urging both the rods in a connected state in a direction of separating the rods from each other; and a coil spring 4 serving as a swaying resistance of the operating member when the operating member 3 is switched from an operating state to an initial state through an urging force of the torsion coil spring 5. Next, details of the aforementioned respective members are clearly explained.

Here, although the housing 1, the rods 2A and 2B, and the operating member 3 are all made of a resin injection-molded article, they may be made of materials other than resin. The coil spring 4 corresponds to an urging member of the present invention, and there is used a compression coil spring (designed with reference to Japanese Industrial Standards, JIS: B2704 and the like) in which a load direction of the coil spring mainly receives a compression stress, and both ends 4*a* and 4*b* are displaced roughly at 90 degrees. The torsion coil spring 5 corresponds to a connection member of the present invention, and there is used a torsion coil spring (designed with reference to Japanese Industrial Standards, JIS: B2709 and the like) in which the load direction of the coil spring mainly receives a torsion stress, and both ends 5*a* and 5*b* are displaced roughly in a V shape by sandwiching a winding portion 5*c*.

Figure 4:
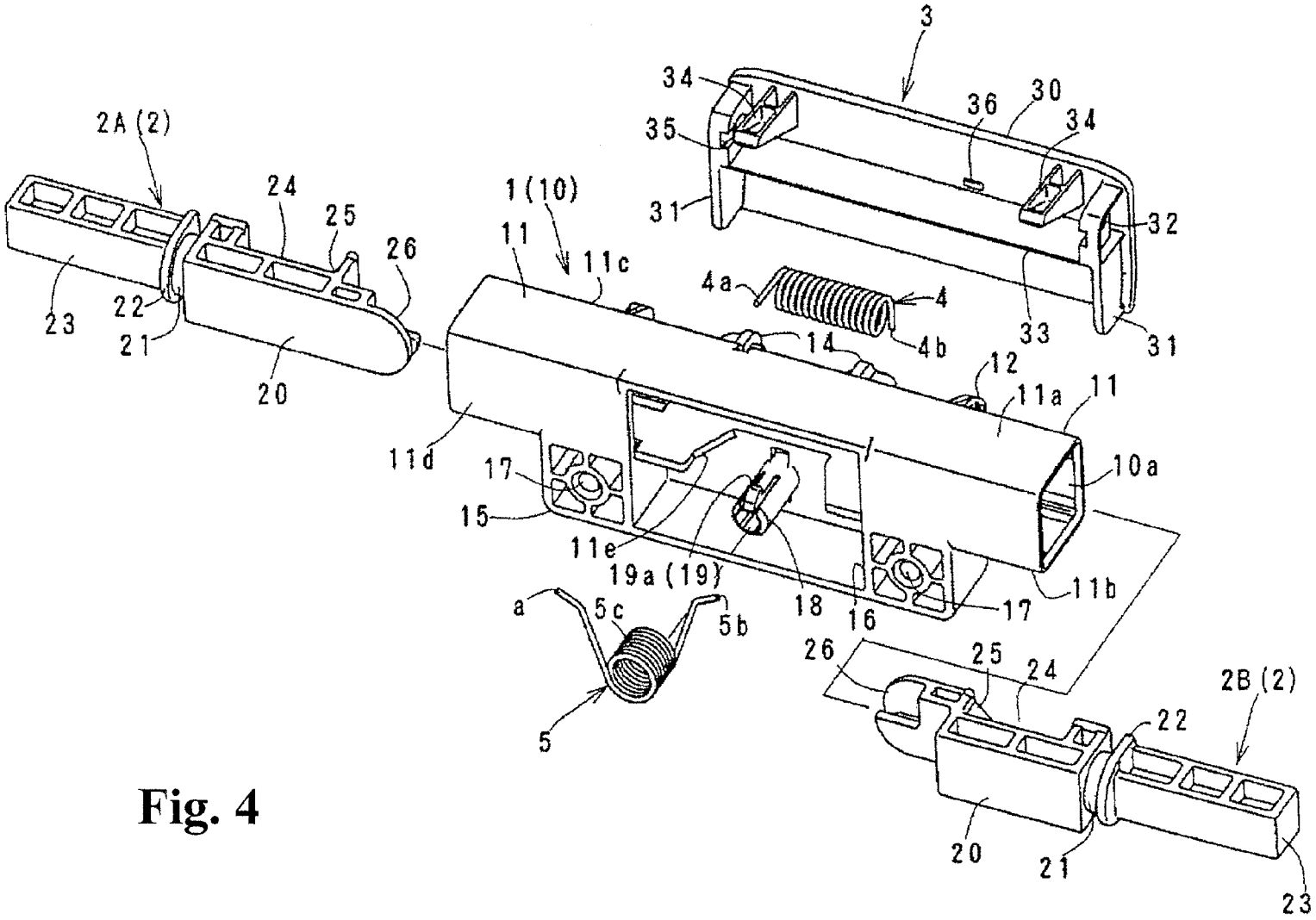
FIG. 4 is an exploded perspective view showing a structure of the lock device.
Figure 5:
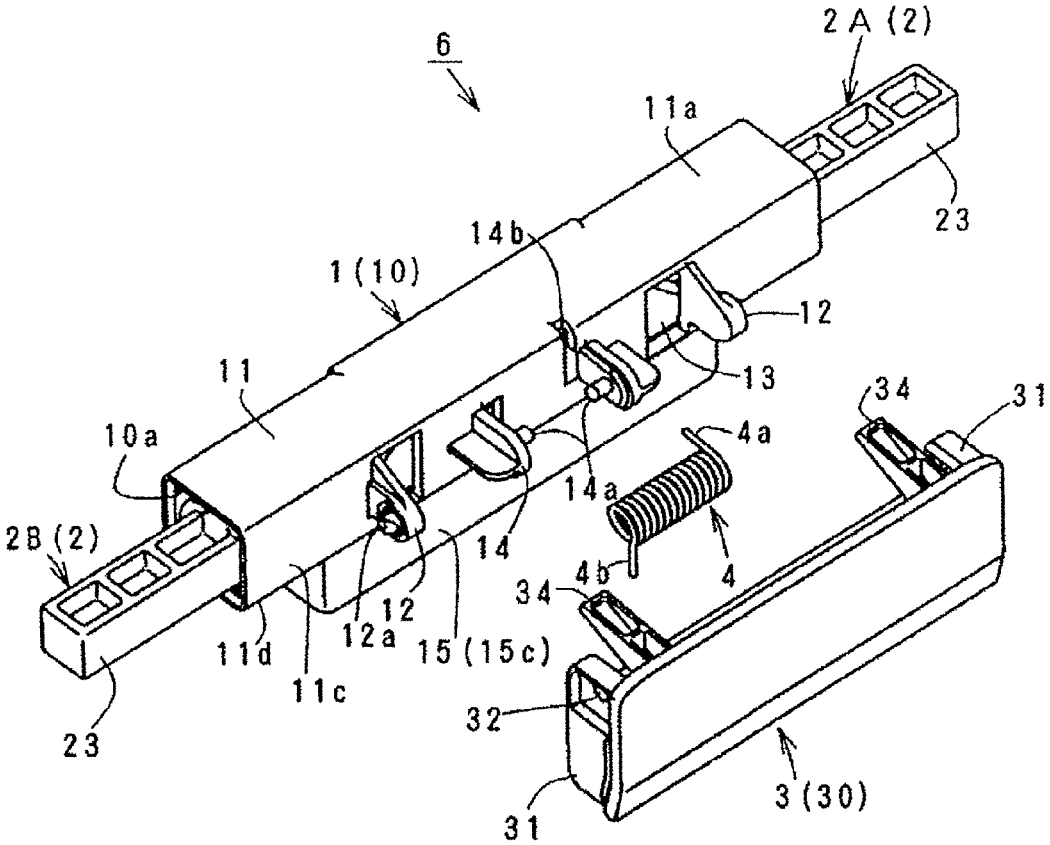
FIG. 5 is an exploded perspective view showing the lock device in a state wherein an operating member and an urging member are removed.

As shown in FIGS. 4 and 5, the housing 1 is partitioned by a main portion 10 long crosswise or to right and left, and a sub-portion 15 provided on a lower side of the main portion 10 and relatively short. Among those, the main portion 10 includes a cylinder portion 11 slidably supporting each rod 2A and 2B; right-and-left connection pieces 12 pivotally supported at the operating member 3; right-and-left through holes 13 introducing arm portions 34 of the operating member 3 into a cylinder with sufficient space; and right-and-left support pieces 14 supporting the coil spring 4. The cylinder portion 11 is partitioned by upper and lower faces 11*a* and 11*b*, a front face 11*c*, and a back face 11*d*, and a cross section has approximately a rectangular shape corresponding to a back portion 20 of the rod. In the front face 11*c*, there are provided the right-and-left connection pieces 12, the two through holes 13, and the right-and-left support pieces 14. In each connection piece 12, there is provided a shaft portion 12*a* to be located on an outside surface, and to be protruded on the same shaft line. Each through hole 13 is a rectangular hole provided inside the connection piece 12 and long up and down. Each support piece 14 includes a shaft portion 14*a* provided between both the through holes 13 and protruded on opposed surfaces. Also, on the front face 11*c*, there is provided a locking groove 14*b* inside the support piece 14 on a right side in a state cut from the upper face 11*a*.

In the lower face 11*b*, there is integrated the sub-portion 15. The sub-portion 15 has a right-to-left length shorter than that of the main portion 10, and is formed in a step shape wherein a front face 15*c* sinks in relative to the front face 11*c* of the main portion, and a back face 15*d* is located on a plane where the back face 11*d* of the main portion is located. On right and left sides of the sub-portion 15, there are provided attachment holes 17 penetrating from the front face 15*c* to the back face 15*d*. The attachment holes 17 are used when the lock device 6 is mounted on an opening/closing body and the like by a stopper such as a screw and the like. In the back face 15*d* of the sub-portion 15, there is provided a window portion 16 located in an intermediate portion and notched in a large rectangular shape including the back face lid on a main portion side. In the window portion 16, there are exposed a support shaft 18 provided to protrude on an inside of the front face of the sub-portion 15; and one portion of the lower face 11*b* partitioning the cylinder portion 11. The support shaft 18 is formed in a cylinder shape and includes an elastic piece portion 19 provided above and below a cylinder and partitioned by a C-shaped slit. In the elastic piece portion 19, there is provided a retaining claw portion 19*a* protruded to an outside of an end. In the lower face 11*b* exposed in the window portion 16, there is provided a notch portion 11*e* located on a side directly above the support shaft 18 and communicating an inside of the sub-portion 15 with an inside of the cylinder portion 11.

Each rod 2A and 2B is disposed slidably in a linear line direction relative to a space 10*a* of the cylinder portion 11, and is switched between the lock position separated from each other, and the release position approaching each other. Namely, each rod 2A and 2B is formed by the back portion 20 disposed slidably in the space 10*a*; an end portion 23 engaged with and disengaged from a lock hole 7*a* formed in a panel 7 as shown in FIGS. 7(*a*) and 7(*b*); a shaft portion 21 disposed between the back portion 20 and the end portion 23; and a plate portion 22. Incidentally, the shaft portion 21 and the plate portion 22 may be omitted.

Figure 6A:
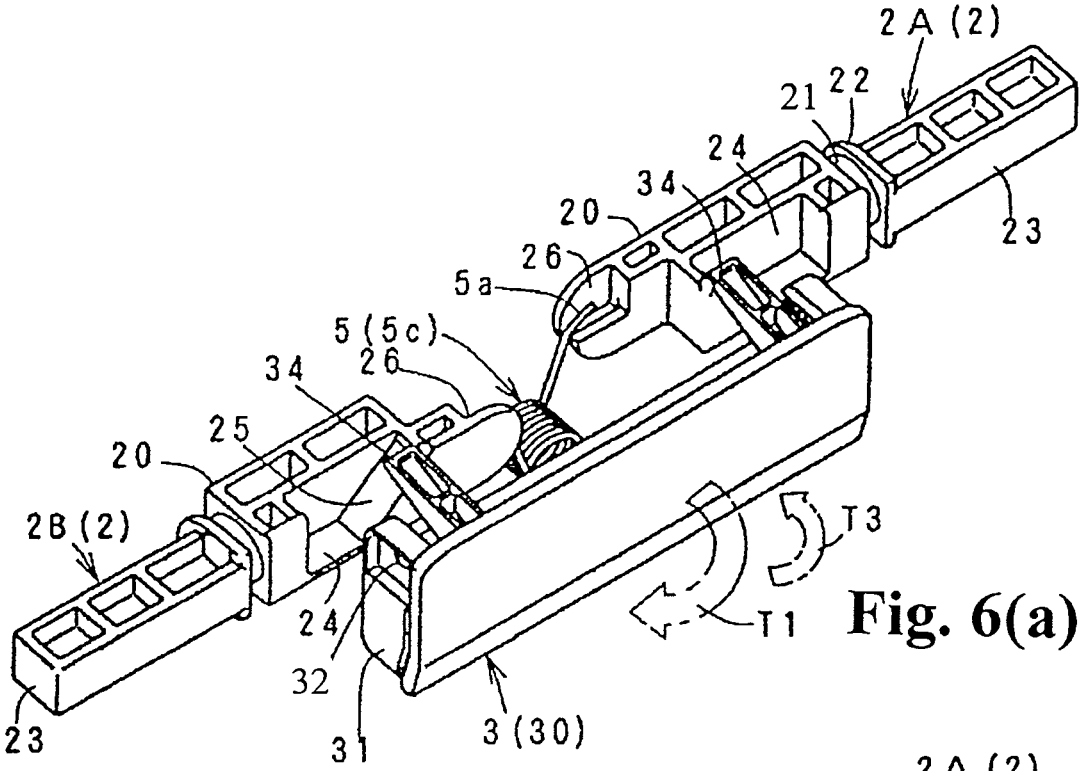
FIGS. 6(*a*) and 6(*b*) are perspective views showing the lock device from the front face side by omitting a housing and the urging member, wherein FIG. 6(*a*) is a drawing showing a rod in a lock position, and FIG. 6(*b*) is a drawing showing the rod in a release position.
Figure 6B:
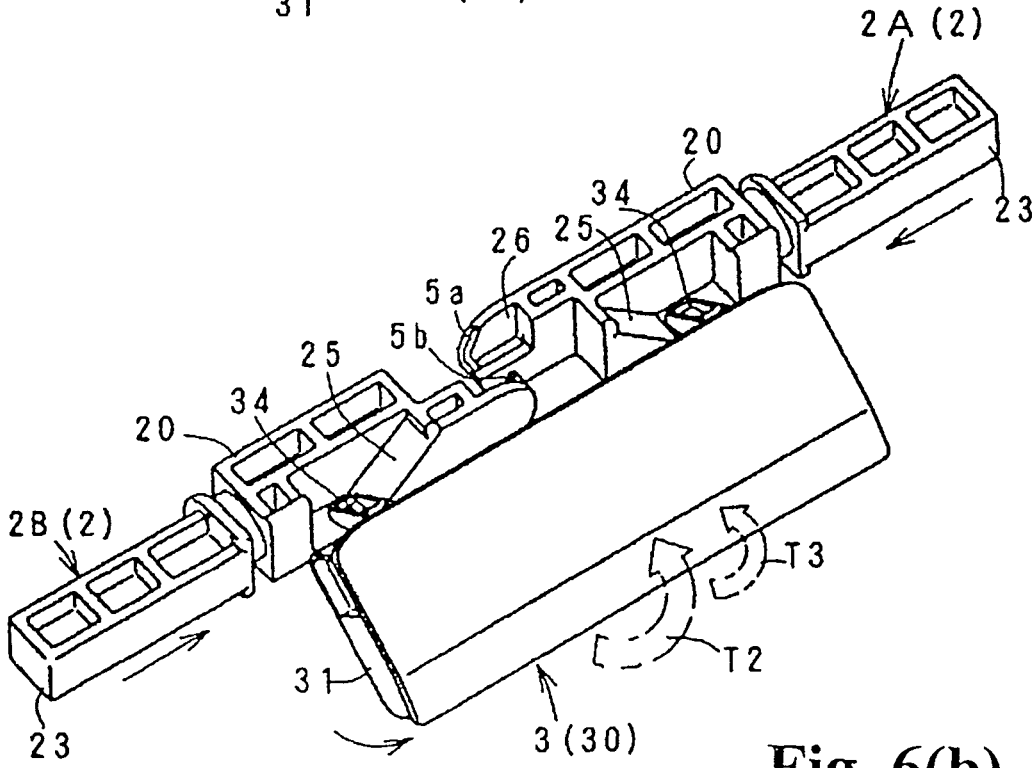

As shown in FIG. 4 and FIGS. 6(*a*) and 6(*b*), in the back portion 20, there are provided a step portion 26 on a back end side locking the corresponding end portion of the torsion coil spring 5; and an inclination portion 25, against which the arm portion 34 of the operating member 3 abuts, on an end side more than the step portion 26. Each step portion 26 is a portion locking the end 5*a* or 5*b* of the torsion coil spring 5 swingably, and is provided in a relationship of approximately facing each other by one rod 2A and the other rod 2B. Namely, the step portion 26 of the rod 2A is located on an end side of the back portion 20 and is provided in such a way as to face the front face 11*c* of the cylinder portion 11 or the operating member 3. On the other hand, the step portion 26 of the rod 2B is located on an end side of the back portion 20, and is provided in such a way as to face the back face lid of the cylinder portion 11. Also, each inclination portion 25 is provided on the same lateral face side of the back portion 20, i.e., a side facing the front face 11*c* of the cylinder portion 11 or the operating member 3. Namely, a lateral face of the back portion 20 is formed in a concave portion 24, and each inclination portion 25 is formed using an end face on a back end portion side of the concave portion 24, and has a tapered face gradually approaching the back end portion side from a bottom upward.

The operating member 3 is formed by a plate body 30 having a size approximately covering an intermediate portion of the front face 11*c* of the cylinder portion and the front face 15*c* of the sub-portion 15. On a back face of the plate body 30, there are provided side plates 31 provided on both sides; shaft holes 32 located on upper sides of both side plates 31, and penetrated on the same shaft line; a divider plate 33 provided in such a way as to partition between both the side plates 31 above and below; and the arm portions 34 located on upper sides than the divider plate 33, and provided to protrude to an inside of each side plate 31. On both side plates 31, there are provided guide grooves 35 leading to the respective shaft holes from plate protruding end sides on facing surfaces. Each guide groove 35 is a groove leading the shaft portion 12*a* of the aforementioned connection piece to the shaft hole 32. On the back face of the plate body 30, there is provided a rib-like contacting portion 36 on a side slightly upper than the divider plate 33. The contacting portion 36 is a portion receiving the end 4*b* of the coil spring 4.

(Assembly) Hereinafter, an example of an assembly procedure of the aforementioned respective members will be explained. In the example, as shown in FIG. 4 and FIG. 5, each rod 2A and 2B is disposed in the space 10*a* relative to the housing 1, and the coil spring 4 is disposed between both the support pieces 14. Namely, in each rod 2A and 2B, the respective back portion 20 is inserted into the space 10*a* of the cylinder portion 11 from a different direction, and each rod 2A and 2B is disposed such that each concave portion 24 is positioned in the corresponding through hole 13. In the coil spring 4, after the shaft portion 14*a* on each support piece side is disposed between both the support pieces 14 while compressing the coil spring 4 so that the shaft portion 14*a* on each support piece side is inserted into a coil inner diameter, one end 4*a* is fitted into the locking groove 14*b* so as to be locked.

Next, the operating member 3 is assembled onto the housing 1. In that case, in the operating member 3, in a state wherein the respective arm portions 34 are inserted into the corresponding through holes 13, both the side plates 31 are pressed against outer sides of the corresponding connection pieces 12. Accordingly, each arm portion 34 protrudes into the concave portion 24 of the corresponding rod 2A or 2B which is inserted into the cylinder portion 11. Consequently, after that, although each rod 2A and 2B is slid inside the cylinder portion 11, the arm portion 34 cannot be pulled out. At the same time, relative to each connection piece 12, the operating member 3 is led along the guide groove 35 of the side plate, where the shaft portion 12*a* on a connection piece side corresponds, and is eventually fitted into the shaft hole 32 so as to be pivotally supported turnably or swayably as a supporting point of the shaft portion 12*a*. At that time, in the structure, the other end 4*b* of the coil spring 4 is pressed against the contacting portion 36, and the operating member 3 is urged in a direction of an arrow T3 which is an operating direction shown in FIGS. 6(*a*) and 6(*b*). Consequently, in a middle state along the assembly, i.e., at a stage prior to incorporating the torsion coil spring 5, compared to the initial state wherein the operating member 3 comes into approximately a vertical posture in FIG. 6(*a*), the operating member 3 is swayed and displaced up to a state close to the operating state wherein the operating member 3 comes into a predetermined inclination posture in FIG. 6(*b*) by an urging force of the coil spring 4.

Next, as shown in FIG. 1(*b*), the torsion coil spring 5 is incorporated. Namely, in the torsion coil spring 5, the support shaft 18 is inserted to pass through an inner diameter of the winding portion 5*c* in a skewered manner, and from a state retained by the claw portion 19*a*, while elastically displacing both ends 5*a* and 5*b* inward, one end 5*a* is latched onto the step portion 26 of one rod 2A, and the other end 5*b* is latched onto the step portion 26 of the other rod 2B. Thereby, the lock device 6 is completed.

(Operation) Hereinafter, main operational characteristics of the lock device 6 formed as described above will be mentioned.

(1) FIGS. 1(*a*), 2(*a*), 3(*a*), 6(*a*), and 7(*a*) show the lock position, i.e., a lock state of each rod 2A and 2B of the lock device 6. In that lock state, each rod 2A and 2B protrudes from the cylinder portion 11 to the maximum by the urging force of the torsion coil spring 5, or is slid until the rods 2A and 2B are separated from each other the most. In a process of sliding each rod 2A and 2B in the direction of separating, each arm portion 34 is moved from a low inclined position to a high inclined position in the inclination portion 25 of the corresponding rod. In the aforementioned lock state, in each rod 2A and 2B, the end portion 23 can be engaged with the lock hole 7*a* formed in the panel 7. Also, in a state wherein the arm portion 34 abuts against the inclination portion 25, the operating member 3 is urged in the direction of the arrow T3 in FIGS. 6(*a*) and 6(*b*) by the urging force of the coil spring 4, so that even if the operating member 3 is subjected to vibrations, the operating member 3 does not wobble so as to prevent rattles.

(2) FIGS. 6(*b*) and 7(*b*) show the release position, i.e., unlock (a lock release) state of each rod 2A and 2B of the lock device 6. First, when the operating member 3 is swayed and operated in an arrow direction in FIG. 6(*b*), i.e., only for a predetermined inclination angle as the supporting point of the shaft portion 12*a* from approximately the vertical posture (the initial state), the lock device 6 is switched from the lock state to the unlock state. In the switching operation, when the operating member 3 is turned in the arrow direction in FIG. 6(*b*) from approximately the vertical posture (the initial state), each arm portion 34 presses the inclination portion 25 of the corresponding rod 2A and 2B, so that by a cam operation of the arm portion 34 and the inclination portion 25, both the rods slide in a direction of approaching against the urging force of the torsion coil spring 5 (accumulating the urging force in the torsion coil spring 5). Consequently, in the aforementioned unlock state, in each rod 2A and 2B, the end portion 23 comes free from the lock hole 7*a* formed in the panel 7 so as to release an engagement.

(3) Then, after the aforementioned lock device 6 is switched to the unlock state, by releasing one's hand from the operating member 3, each rod 2A and 2B slides in the direction of separating by the urging force of the torsion coil spring 5 so as to come into the lock state again. The operating member 3 is returned to approximately the vertical posture (the initial state) in FIG. 6(*a*) from the predetermined inclination angle in FIG. 6(*b*) by the cam operation of the arm portion 34 and the inclination portion 25 at a speed proportional to the urging force of the torsion coil spring 5. At that time, supposedly, compared to a case without the coil spring 4, the operating member 3 is returned against the urging force of the coil spring 4, so that a tapping sound at a return time is suppressed. Thereby, the lock device 6 reliably controls or reduces especially a conventional tapping sound easily over a long period so as to improve a quality.

In other words, in the aforementioned lock device 6, the coil spring 4 and the torsion coil spring 5 are set so as to function as follows. In FIG. 6(*a*), the reference symbol T1 represents a spring load in which the operating member 3 receives the urging force of the torsion coil spring 5 through the rod 2A or 2B; the reference symbol T3 represents a spring load in which the operating member 3 receives from the coil spring 4; and the reference symbol T2 represents an operating load applied to the operating member 3 when the rod is switched from the lock state in FIG. 6(*a*) to the unlock state in FIG. 6(*b*). In a relationship with the lock state in FIG. 6(*a*), the spring load T3 of the coil spring 4 acts as an opposing force against T1, i.e., acts as a brake so as to control or reduce the tapping sound at the aforementioned return time. On the other hand, in a relationship with the unlock state in FIG. 6(*b*), the spring load T3 of the coil spring 4 acts in the same direction as the operating load T2 necessary for switching the operating member 3 from the initial state to the operating state so as to act as an assist in reducing the operating load.

Incidentally, in the lock device of the present invention, the details can be modified or developed by reference to the explanation described hereinabove provided that a specified structure of the present invention is provided. As one example thereof, as for the connection member, in place of the torsion coil spring 5, both the rods can be urged in a separating direction by a simple coil spring (the compression coil spring and the like). In such structure, although the lock device is elongated in a shaft line direction of the housing, a space in a direction orthogonal to a shaft line can be controlled to be small.

All contents of the specification, claims, drawings, and abstract of Japanese Patent Application No. 2011-206686 filed on Sep. 22, 2011 are cited in their entireties herein and are incorporated as a disclosure of the specification of the present invention.

What is claimed is:

1. A lock device for an opening and closing member attached to a main member, comprising:

a housing including a front face, a back face located opposite to the front face so as to form a space therebetween and having a window portion opened outwardly, and a support shaft protruding from the front face toward the window portion in the space;

a pair of rods slidably supported in the housing and respectively including end portions adapted to be engaged with and disengaged from lock holes in a panel, and back side portions with inclination portions, the rods sliding in first and second linear directions relative to the housing to move between a lock position separated from each other, in which the end portions are engaged with the lock holes, and a release position approaching each other, in which the end portions are disengaged from the lock holes;

an operating member turnably attached to the housing and including arm portions, each of the arm portions protruding toward a respective one of the rods to abut against a respective one of the inclination portions, the operating member turning in a direction from an initial state to an operating state to switch the rods from the lock position to the release position;

a connection member disposed on the support shaft and including one end engaging the back side portion of one of the rods, and another end engaging the back side portion of the other one of the rods, the connection member urging the rods in the first linear direction to move away from each other and be separated; and an urging member disposed between the housing and the operating member, and providing an opening force on the operating member, the opening force being less than an urging force of the connection member urging the rods in the first linear direction so as to damp the movement of the operating member back to the initial state from the operating state, wherein when the operating member is turned from the initial state to the operating state, the rods slide in the second linear direction to approach each other against the urging force of the connection member through a cam operation between the inclination portions and the arm portions, and each of the rods includes a concave portion which forms each of the inclination portions thereon, and each inclination portion is outwardly tapered from each of the back side portions such that the respective arm portions press the respective inclination portions to provide the cam operation.

2. A lock device according to claim 1, wherein the urging member is a coil spring.

3. A lock device according to claim 1, wherein the connection member is a torsion coil spring.

4. A lock device according to claim 3, wherein the torsion coil spring includes a winding portion arranged at a portion deviated from a shaft line in the first and second linear directions of the rods.

5. A lock device according to claim 1, wherein the opening force of the urging member urges the operating member in the direction of the operating state.

6. A lock device according to claim 1, wherein the housing includes a locking groove configured to fit one end of the urging member therein, and the operating member includes a contacting portion to press another end of the urging member such that the urging member provides the opening force on the operating member in the direction of the operating state of the operating member.

7. A lock device according to claim 1, wherein the housing includes a cylinder portion storing the rods therein and having a lower face portion, and a sub-portion integrally connected to the lower face portion and storing the support shaft therein, and the cylinder portion has a length in the first and second linear directions longer than that of the sub-portion.

8. A lock device according to claim 7, wherein the lower face portion has a notch portion notched to communicate the cylinder portion and the sub portion in the space of the housing, and the connection member is disposed on the support shaft such that the ends of the connection member extend to the back side portions of the rods stored in the cylinder portion through the notch portion.

* * * * *